US007185408B1

(12) United States Patent
Keith

(10) Patent No.: US 7,185,408 B1
(45) Date of Patent: Mar. 6, 2007

(54) MOUNTING DEVICE FOR A GARBAGE DISPOSAL

(75) Inventor: John R. Keith, Parma, OH (US)

(73) Assignee: Louise R. Keith, Parma, OH (US)

( * ) Notice: Subject to any disclaimer, the term of this patent is extended or adjusted under 35 U.S.C. 154(b) by 166 days.

(21) Appl. No.: 11/135,087

(22) Filed: May 23, 2005

(51) Int. Cl.
*B23P 19/04* (2006.01)

(52) U.S. Cl. ..... 29/229; 29/268; 29/225

(58) Field of Classification Search ..... 29/229, 29/225, 268, 450, 451
See application file for complete search history.

(56) References Cited

U.S. PATENT DOCUMENTS

| | | | | |
|---|---|---|---|---|
| 2,323,224 | A * | 6/1943 | Kuhnle | 4/286 |
| 2,846,154 | A | 8/1958 | Wieczorek | |
| 3,104,400 | A | 9/1963 | Lantz et al. | |
| 3,477,747 | A | 11/1969 | Clements | |
| 3,711,874 | A | 1/1973 | Gajer | |
| 3,768,742 | A | 10/1973 | Preher et al. | |
| 3,797,764 | A | 3/1974 | Guth | |
| 3,982,703 | A | 9/1976 | Meyers | |
| 4,135,258 | A | 1/1979 | Braga et al. | |
| 4,411,054 | A | 10/1983 | Zeilenga | |
| 5,177,853 | A * | 1/1993 | Herook | 29/266 |
| 5,318,230 | A | 6/1994 | Ferguson et al. | |
| 5,343,607 | A | 9/1994 | Southerland, Jr. et al. | |
| 5,560,052 | A | 10/1996 | Ferguson et al. | |
| 5,584,110 | A | 12/1996 | Mordoch | |
| 5,875,536 | A | 3/1999 | Ring | |
| 6,360,419 | B1 * | 3/2002 | Newcomer | 29/451 |
| 6,477,756 | B2 | 11/2002 | Newcomer | |
| 6,557,229 | B1 * | 5/2003 | Ricci | 29/266 |
| 6,615,474 | B2 | 9/2003 | Ramirez | |

* cited by examiner

*Primary Examiner*—Lee D. Wilson
*Assistant Examiner*—Alvin J Grant
(74) *Attorney, Agent, or Firm*—Pearne & Gordon LLP

(57) ABSTRACT

A tool for installing a garbage disposal to a sink flange extending below a sink includes a keeper and a platform. The keeper includes a head portion for engaging the sink flange above the sink and a leg portion extending along the sink axis through the sink flange. The platform carrying disposal mounting rings is releasably engaged with the leg portion below the sink to position it adjacent to and aligned with the end of the sink flange body. A snap ring is biased from the platform onto the flange body and into the annular groove in the flange body to trap the back-up ring and mounting ring on the flange body below the sink. The platform is disengaged from the leg portion and the tool is removed so that the disposal may be secured to the mounting ring in a known manner.

18 Claims, 6 Drawing Sheets

64
60
20
66
94
92
96
72
92
82
94
96
90
62
84
86
88
70
94
92
96

MOUNTING DEVICE FOR A GARBAGE DISPOSAL

BACKGROUND OF THE INVENTION AND RELATED ART

The present invention relates to garbage disposal devices and their installation. More particularly, a tool or mounting device is provided for use in installing the garbage disposal support rings and positioning a snap ring or a locking ring in an annular groove on a sink flange. The snap ring secures the support rings on the sink flange and the disposal is hung from the support rings.

A significant factor in the difficulty of mounting garbage disposals is that the installer must operate from below the sink and, in this position, install the support rings and insert the snap ring into the annular groove on the sink flange. More particularly, the support ring components include a back-up ring and a mounting ring which must be fitted over the sink flange body below the sink, and then the snap ring must be opened and placed in the annular groove to fix the components on the flange body. Thereafter, the disposal may be hung from the mounting ring.

Typically, the snap ring is opened and advanced along the flange body surface. In order to prevent the sink flange from being pushed upwardly out of the drain opening, a second person works from the top of the sink to hold the sink flange in place. It is desirable to avoid the need of a second person to assist in the installation.

U.S. Pat. No. 5,584,110 discloses a snap ring mounting tool that directly mounts to the lower opening of the sink flange by means of detents or a resilient lip. The tool includes a frustoconical surface having an upper diameter slightly larger than that of the flange and tapering to a lower diameter less than the internal diameter of the snap ring. Accordingly, the installer pushes the snap ring along the frustoconical surface until the ring is received in the annular groove on the flange body. The movement of the snap ring tends to lift the sink flange upwardly, and it is necessary to restrain such movement.

U.S. Pat. Nos. 6,360,419 and 6,477,756 disclose a tool comprising a first cylindrical member having a conical surface including an annular groove which carries the snap ring during installation. A second cylindrical member has a female mating conical surface used to advance the snap ring into the annular groove on the sink flange. Once again, during installation of the snap ring, upward forces may be imposed upon the sink flange causing it to dislodge from its mounting within the sink drain opening.

U.S. Pat. No. 4,411,054 discloses a clamping device including a tee-bolt having a head that engages the sink flange adjacent the top of the sink and a threaded body extending through the flange for threaded engagement with an upwardly opening yoke that works against the bottom of the sink. The clamping device fixes the position of the sink flange, but does not control or assist in the positioning of the back-ring or the mounting ring as the snap ring is manually positioned in the annular groove in the sink flange. Also, if the threaded body is tightened excessively, there is a risk that the tee-bolt will over-load the sink flange and damage the finish of the upper surface of the sink.

U.S. Pat. No. 6,615,474 discloses a hand operated pliers-like tool used to open the snap ring and to place the open ring in the annular groove. Although this reduces the forces applied to the sink flange and may reduce the need for a second person, it does not directly assist in the placement and position control of the additional ring components.

More particularly, the back-up ring and the mounting ring are not confined and must be positioned by hand as the snap ring is installed.

U.S. Pat. No. 5,343,607 discloses a tool for installing a gasket and a snap ring into a seating groove in a hollow tube such as a pipe. The tool includes a pair relatively movable forward and rearward plates carried on a shaft and resiliently spaced apart by a coil spring. The snap ring is compressed into a loading groove on the forward plate and positioned adjacent the seating groove. A plurality of pins extend from the rearward plate into the loading groove. Accordingly, movement of the rearward plate towards the forward plate pushes the snap ring from the loading groove and into the seating groove.

SUMMARY OF THE INVENTION

In accordance with the invention, a tool or device is provided to mount the snap ring into the annular groove of a sink flange while fixing the position of the sink flange as the snap ring is inserted into the annular groove in the sink flange. Further, the tool assists in the placement and positioning of additional disposal support ring components during installation of the snap ring.

The tool comprises a keeper and a platform for temporarily fixing the sink flange within the drain opening and positioning the snap ring in an expanded condition adjacent to and aligned with the lower end of the sink flange body for movement of the snap ring into the annular groove. The keeper includes a head portion that engages the sink flange and a leg portion that extends from the head portion through the sink flange to align and support the platform carrying the expanded snap ring. The platform includes a connector for releasably locking the platform to the leg portion of the keeper.

The platform includes a recess for receiving the lower end of the sink flange. The recess surrounds a loading shoulder that extends from the platform for receiving the snap ring. The shoulder has a diameter slightly larger than the outside diameter of the lower body of the sink flange, and the snap ring is fitted over the loading shoulder in an expanded condition. The expanded snap ring may therefore be advanced axially from the shoulder onto the lower body of the sink flange and into the annular groove. To that end, a biasing device is mounted on the platform to advance the snap ring from the loading shoulder onto the sink flange body and into the annular groove.

In preparation for installation, the back-up ring is nested on the mounting ring in the orientation in which the rings are to be installed onto the sink flange. The platform includes a mount for the nested support ring and the nested back-up ring, and the nested rings are mounted on the platform. Therefore, the axial alignment of the platform adjacent the lower end of the sink flange also aligns and positions the nested ring assembly around the sink flange. Upon insertion of the snap ring into the annular groove, the nested rings are retained on the sink flange above the snap ring.

The platform is engaged by the leg portion and releasably secured to the leg portion with the lower end of the flange body received in the platform recess and the head portion of the keeper engaged with the sink flange. The leg portion extends through the platform and the projecting end of the leg portion may be grasped by the installer to fix the tool and the sink flange in position. In this manner, the tool operates between the upper or top surface of the sink and the platform to entrap the various elements and to maintain the proper positioning of the sink flange in the sink drain opening during the placement of the ring components and the insertion of snap ring into the annular groove.

The tool thereby facilitates the installation of the garbage disposal by fixing the position of the sink flange and controlling the various mounting components during assembly as the snap ring is inserted in the annular groove.

DETAILED DESCRIPTION OF THE DRAWINGS

Figure 1:
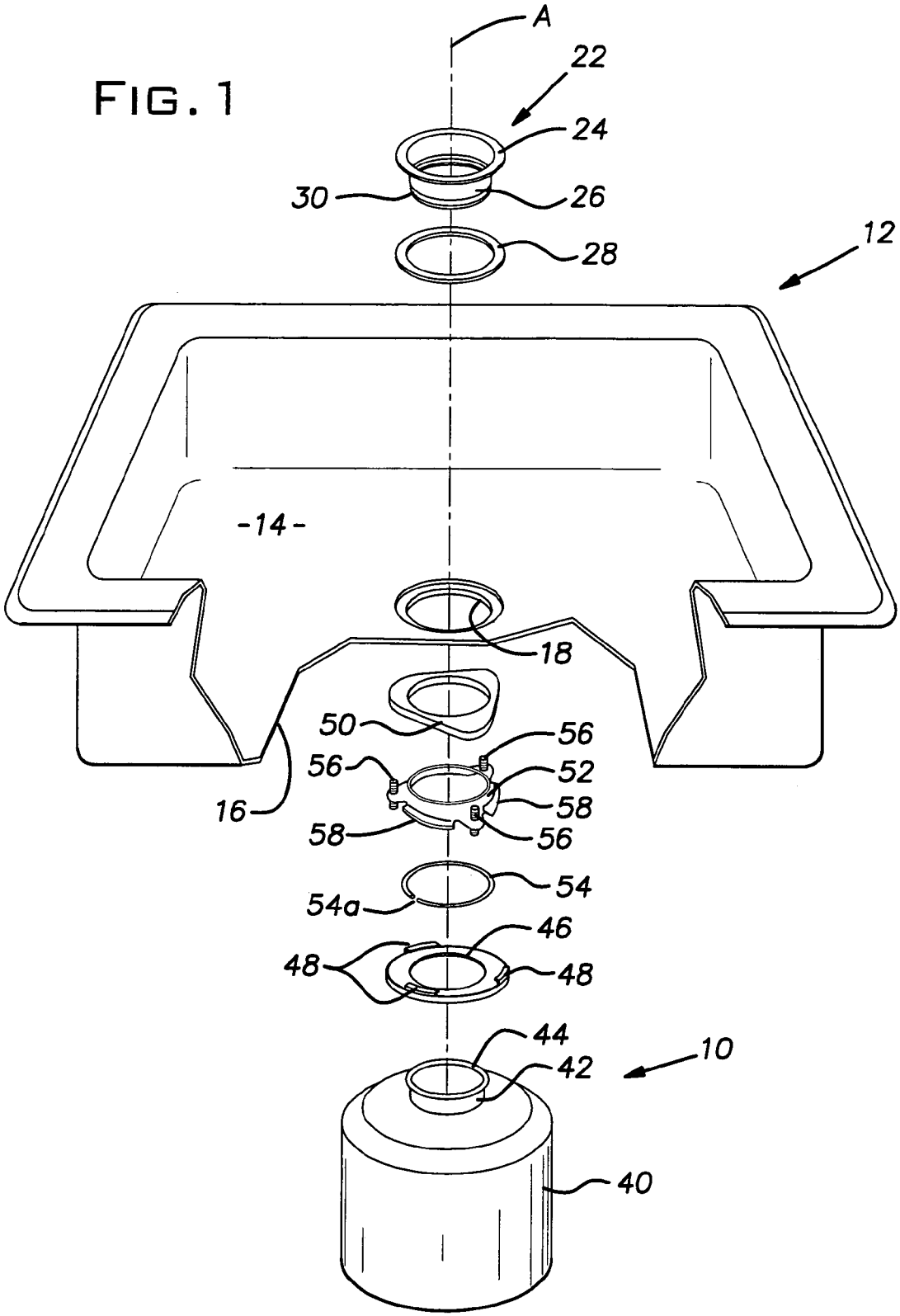
FIG. 1 is an exploded perspective view of a garbage disposal and the support components for mounting the disposal to a sink flange below a sink.

Referring to FIG. 1, a garbage disposal 10 to be mounted below a sink 12 is shown. The sink 12 includes a sink top or upper surface 14 and a sink bottom or lower surface 16. A sink drain opening 18 extends between the upper and lower surfaces 14 and 16.

The components are assembled and mounted along a central axis "A" extending through the drain opening 18. As described below, the installation of the disposal 10 below the sink 12 is simplified and expedited by the use of the tool 20 (FIG. 2) of the present invention.

Referring to FIGS. 1 to 5, a sink flange 22 is to be mounted in the drain opening 18. To that end, the sink flange 22 includes a flange lip 24 and a flange body 26 having a tubular or cylindrical shape. The flange lip 24 engages the sink upper surface 14 about the drain opening 18, and the flange body 26 extends through the opening and below the sink lower surface 16. A flange gasket 28 may be provided between the flange lip 24 and the upper sink surface 14 or a seal may be provided with a putty material.

An annular groove 30 extends around the flange body 26. The flange body 26 extends to a lower end 32 which terminates at an in-turned lip 34. The garbage disposal 10 is mounted or hung from the sink flange 22 below the sink 12.

Referring to FIG. 1 as described below, the garbage disposal 10 includes a disposal body 40 having a body collar 42 that is connected to the flange body 26 for receiving flow through the drain opening 18 and sink flange 22. The collar 42 has an upper lip 44 for engaging a body ring 46. The body ring 46 has three angularly spaced body ring hooks 48 to be used in a bayonet-type mounting of the disposal 10 with conventional support ring hardware as described below.

The support ring hardware includes a back-up ring 50 and a mounting ring 52 secured to the flange body 26 by a snap or locking ring 54 received within the annular groove 30. More particularly, the inside diameters of the back-up ring 50 and the mounting ring 52 are sized to fit over the flange body 26 during installation and to then be trapped in position by the insertion of the snap ring 54 in the annular groove 30. The snap ring 54 is split, as shown at 54*a* in FIG. 1, to facilitate its expansion and mounting.

The mounting ring 52 includes three angularly spaced mounting screws 56 which adjustably engage the back-up ring 50 to fix it against the lower surface 16 of the sink a known manner. The mounting ring 52 also includes three angularly spaced mounting ledges 58 which engage the body ring hooks 48 to secure the disposal body 40 to the flange body 26.

Figure 2:
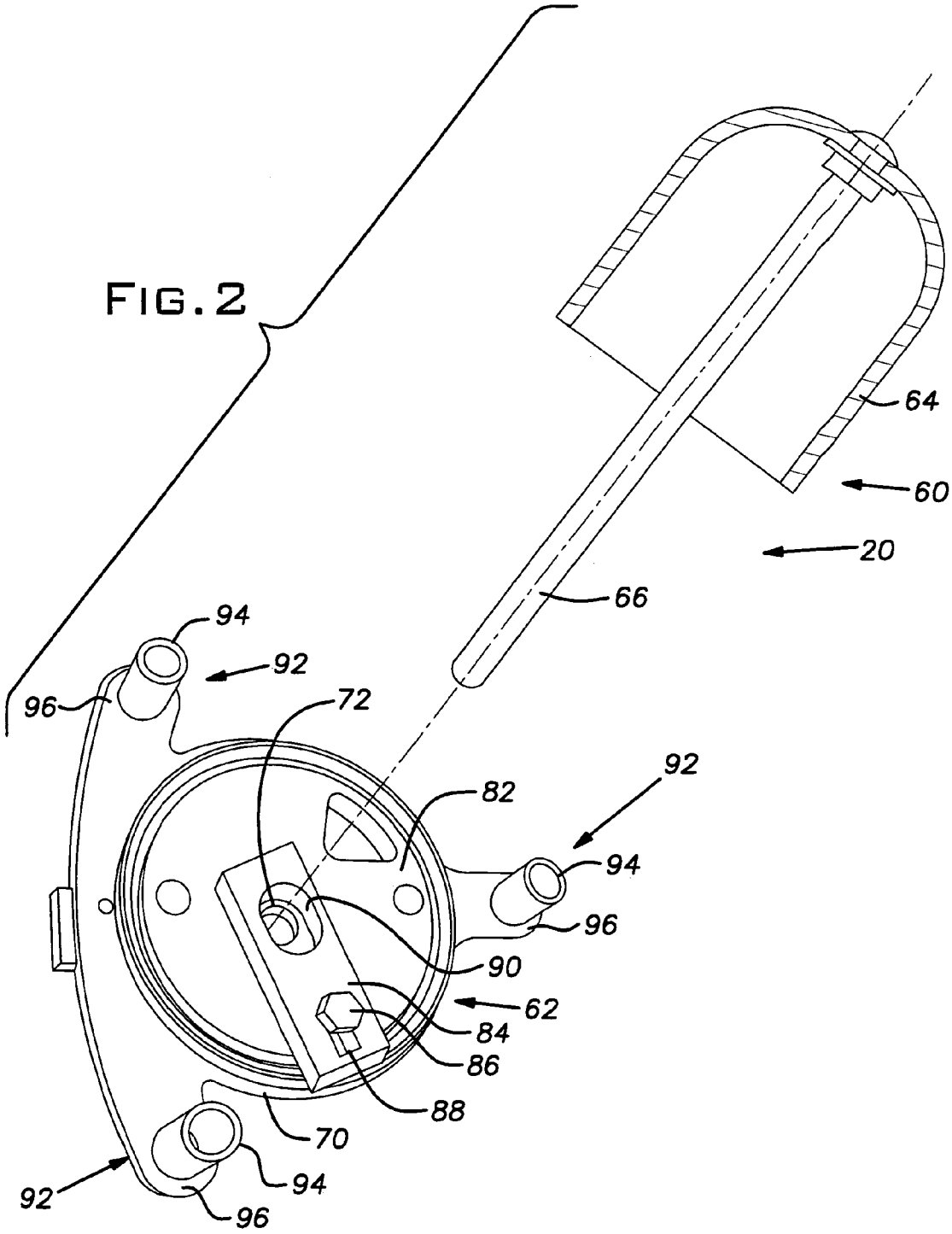
FIG. 2 is an exploded perspective view, partially in section, of the tool in accordance with the invention including a keeper and a platform.
Figure 3:
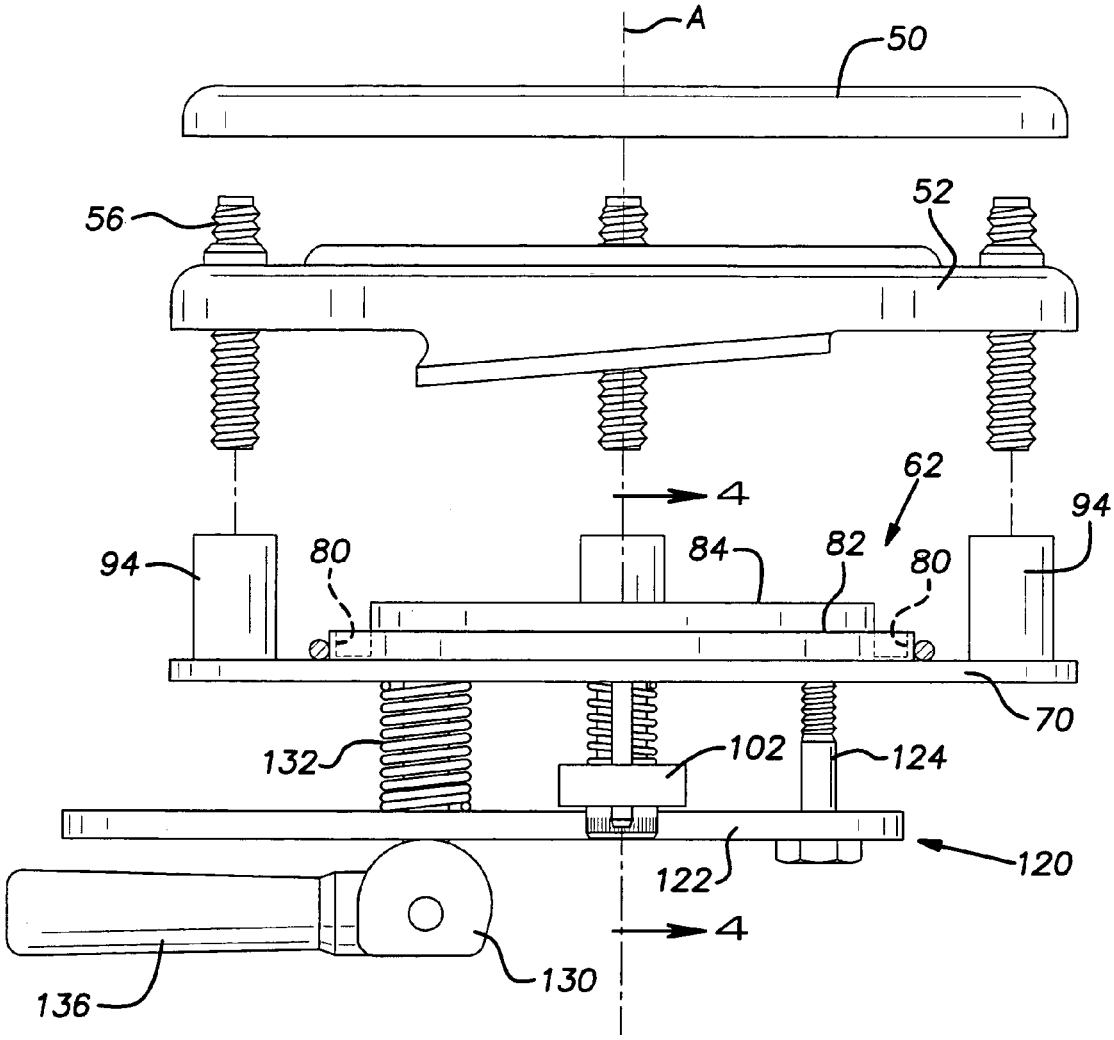
FIG. 3 is an exploded side view showing the platform with a connector in an unlocked position and a latch member in a retracted position together with a back-up ring and a mounting ring to be nested on the platform prior to mounting on the sink flange.

Referring to FIGS. 2 and 3, the tool 20 includes as its major components a keeper 60 and a platform 62. For convenience, the proper alignment of these components along the axis A is also shown.

Figure 6:
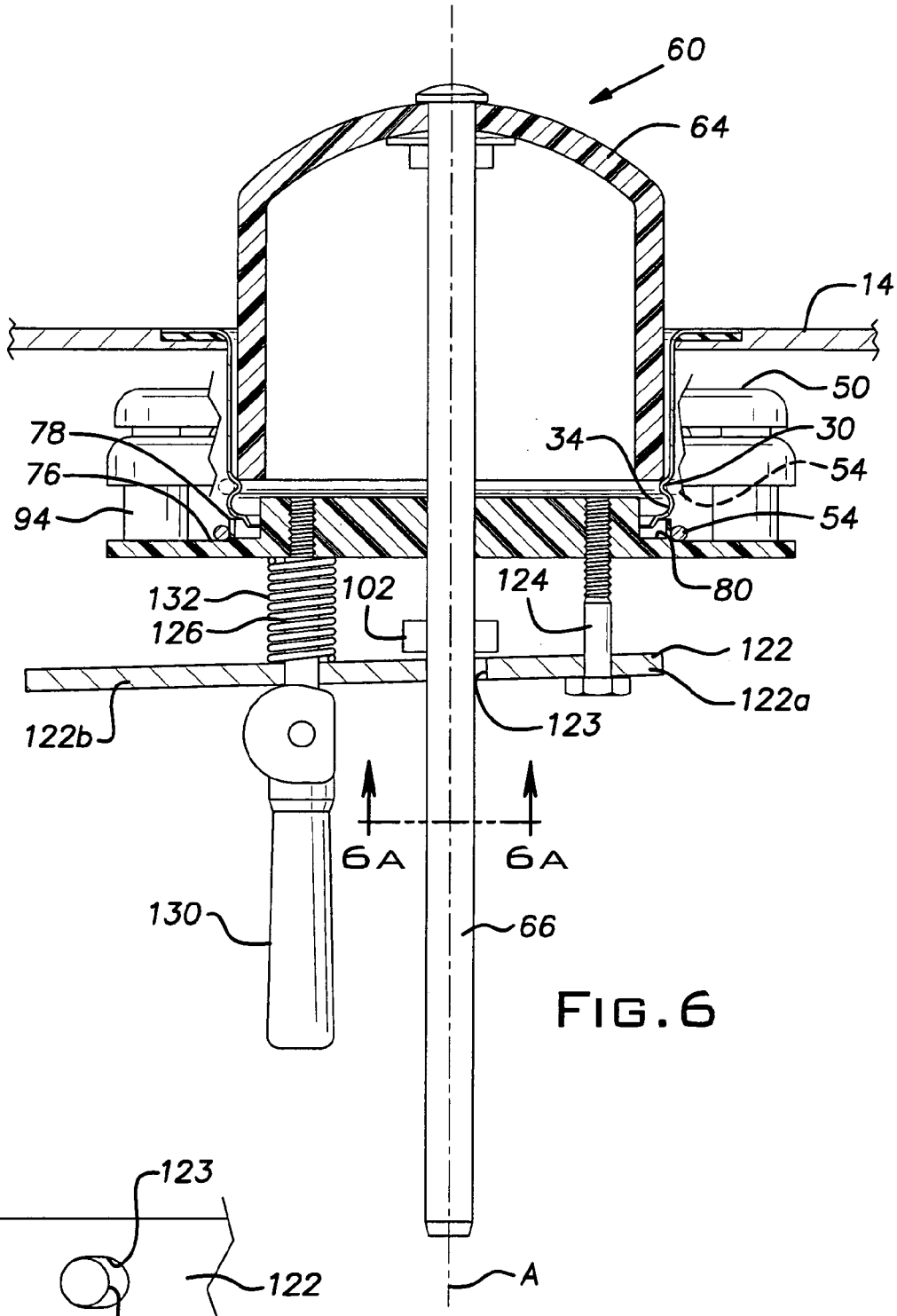
FIG. 6 is an exploded side view similar to FIG. 4 showing the keeper head portion engaged with the sink flange and the leg portion locked to the platform to align and secure the platform adjacent the lower end of the sink flange body.

The keeper 60 includes a head portion 64 connected to an axially extending leg portion 66. The head portion 64 has a closed end connected to a cylindrical portion having an outside diameter sized to fit within the sink flange 22 as best shown in FIG. 6. In this manner, the head portion 64 centers the leg portion 66 along the axis A of the drain opening 18 for engagement with the platform 62.

The keeper 60 may be formed of any suitable material such as metal or plastic, and it may be formed as a single piece or joined components as shown. The keeper 60 is formed of PVC, and the leg portion 66 may be heat welded, glued and/or secured by a fastener to the head portion 64.

The platform 62 includes a base 70 having a generally flat configuration and a central opening or clearance bore 72 for receiving the leg portion 66 of the keeper 60. A loading shoulder 74 projects from the base 70 and receives the snap ring 54 in an expanded condition. The shoulder 74 includes a radial base 76 and axial wall 78.

An annular recess 80 is provided in the base 70 radially inward on the shoulder 74. The recess 80 receives the in-turned lip 34 of the flange body 26 during the installation process as best shown in FIG. 6.

The base 70 also includes a projecting central hub 82 that supports a radially movable latch 84. To that end, the latch 84 is secured to the hub 82 by a fastener 86 extending through a slot 88 in the latch. The fastener 86 may be loosened in order to allow the latch 84 to be moved between radially inward and radially outward directions.

The latch 84 is shown in a radially outward position in FIG. 2 for use in mounting the snap ring 54 over the loading shoulder 74. An annular segment of the snap ring 54, preferably including the split 54*a* in the ring, is slipped under the overhanging portion of the latch 84 against the shoulder 74. The overhanging portion of the latch 84 serves to trap the snap ring 54 against the shoulder 74 as the remaining portions of the ring are expanded radially outwardly and downwardly over the shoulder 74.

After the snap ring 54 has been mounted on the shoulder 74, the fastener 86 may be loosened and the latch 84 may be moved in a radially inward direction clear of the loading shoulder 74 as shown in FIG. 3. The latch 84 has an opening 90 adjacent the central opening 72 for passage of the leg portion 66 of the keeper 60. For convenience, the opening 90 may have an elongate or slot shape.

The platform 62 also includes a ring assembly mount 92 comprising three angularly spaced cups 94 for receiving the three mounting screws 56 of the mounting ring 52. The base 70 of the platform 62 is provided with three angularly space ears for supporting the cups 94.

Figure 4:
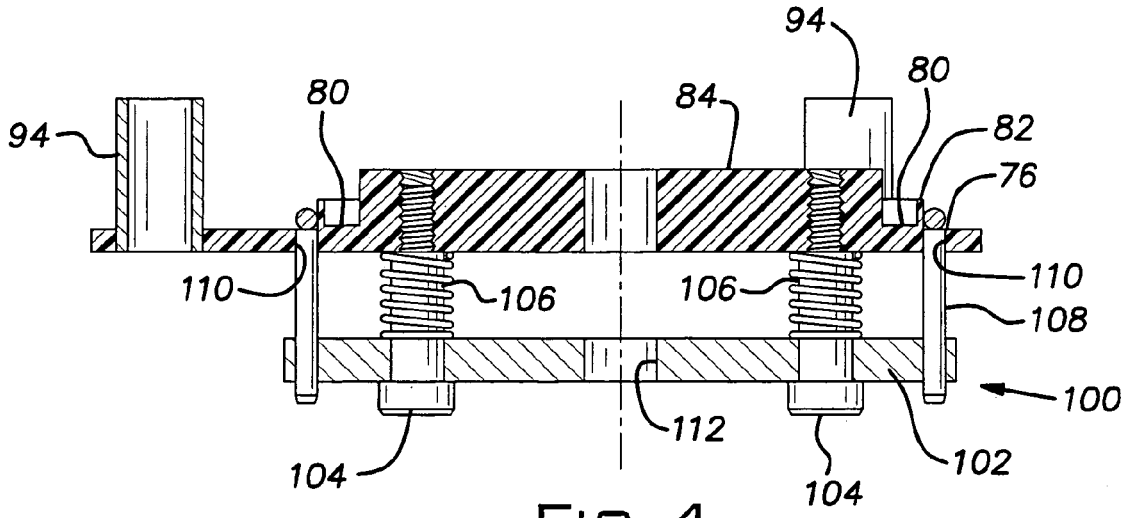
FIG. 4 is a sectional view taken along the line 4—4 in FIG. 3 with parts omitted for clarity of illustration.

Referring to FIG. 4, the platform 62 also includes a biasing device 100 for moving the snap ring 54 from the loading shoulder 74 onto the flange body 26 and into the annular groove 30. The device 100 includes a slide bar 102 supported for axial movement along mounting screws 104. The slide bar 102 is normally biased away from the platform 62 by springs 106 surrounding each of the screws 104.

A pair of pins 108 are rigidly secured to the slide bar 102 and respectively extend through clearance bores 110 extending through the base portion 70 and opening into the radial base wall 76 of the loading shoulder 74. Accordingly, advance of the slide bar 102 towards the platform 62 causes the pins 108 to push the snap ring 54 along the axial wall 78 of the loading shoulder 74, onto the flange body 26 and into the annular groove 30. As discussed further below, the slide bar 102 also includes a clearance bore 112 for receiving the leg portion 66 of the keeper 60 and assuring alignment of the platform 62 with the end of sink flange 22.

Referring to FIGS. 3 and 6, the platform 62 also includes a locking connector 120 for releasably securing the platform 62 to the leg portion 66 of the keeper 60. The locking connector 120 includes a pivot or locking bar 122 having a slot 123 through which the leg portion 66 freely passes when in the unlocked condition.

Figure 3A:
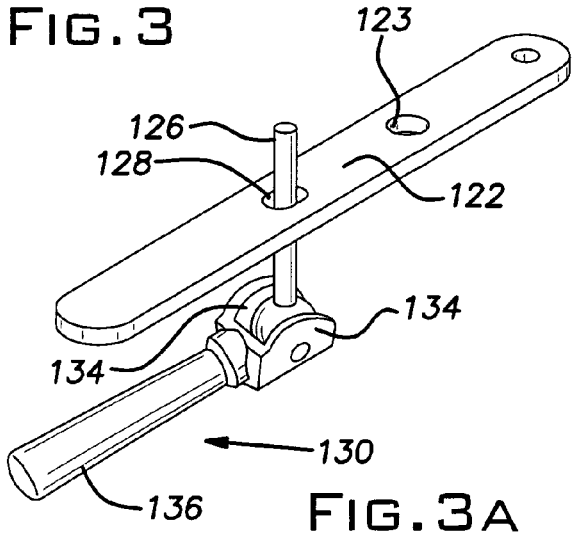
FIG. 3*a* is a fragmentary perspective view of a portion of the connector shown in FIG. 3.

The proximal end 122*a* of the bar 122 is secured to the base 70 of the platform 62 by a fastener 124. A mounting pin 126 extends from the base 70 through a slot 128 in the distal end 122*b* of the bar 122 as best shown in FIG. 3*a*. The remote end of the pin 126 is connected to a cam handle 130 operable between locking and unlocking positions. A spring 132 surrounding the mounting pin 126 biases the bar 122 away from the base portion 70 of the platform 62.

Figure 6A:
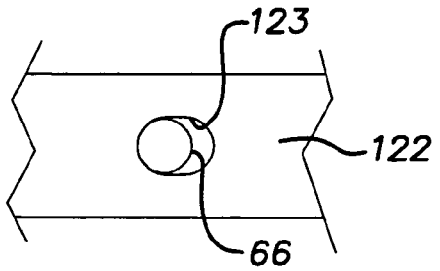
FIG. 6*a* is a fragmentary bottom view taken along the line 6*a*—6*a* in FIG. 6 with parts omitted for clarity of illustration.

As shown in FIG. 3*a*, the cam handle 130 may be formed with a pair of spaced cams 134 extending from one end of a lever 136. The cam handle 130 is in an unlocked position in FIG. 3 and the leg portion 66 freely passes through the slot 123. When the cam handle 130 is moved to the locked position, the spring 132 biases the bar 122 to the angular position shown in FIG. 6, and the leg portion 66 is frictionally engaged within the slot 123 as shown in FIG. 6*a*.

The use of the tool 20 in the installation of the garbage disposal 10 is described hereinafter.

Figure 5:
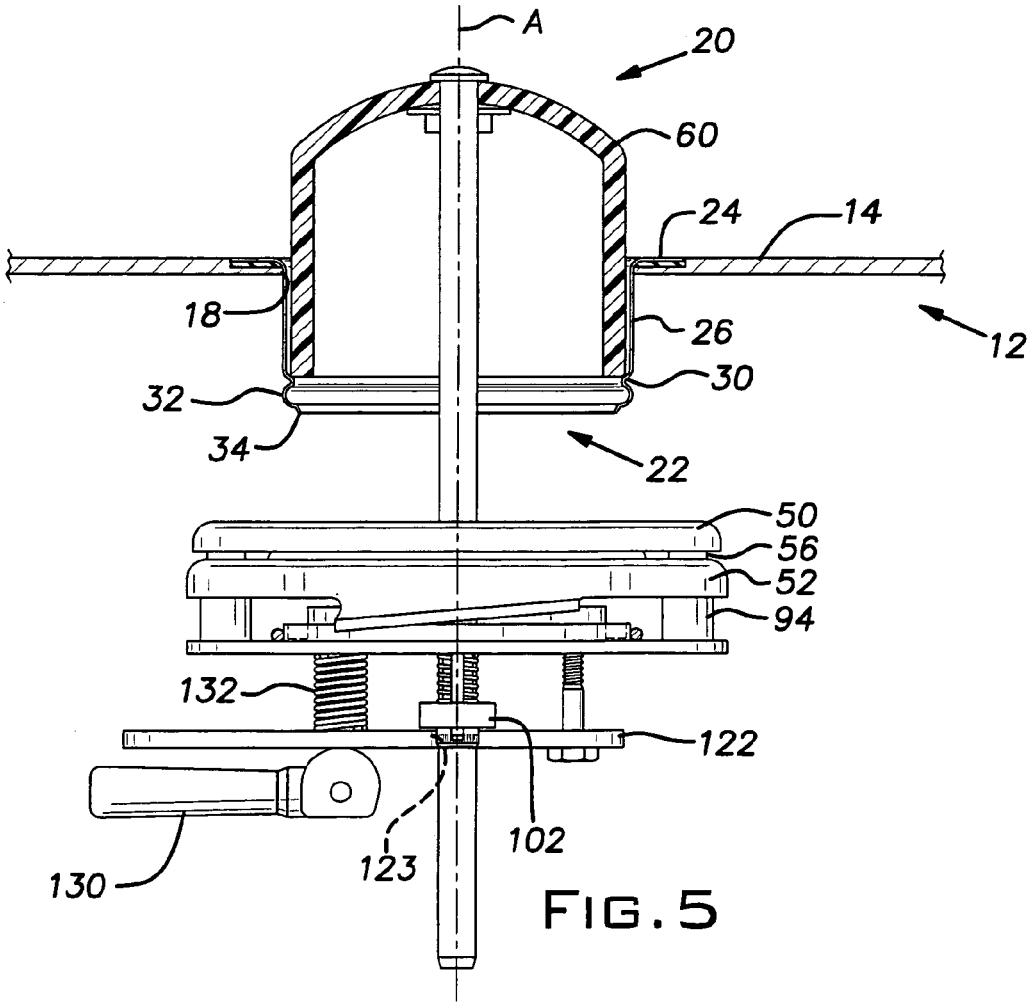
FIG. 5 is an exploded side view, partially in section, showing the keeper head portion positioned in a sink flange and leg portion engaged with the platform carrying the nested back-up ring and mounting ring.

Referring to FIGS. 3 and 5, the back-up ring 50 is nested onto the mounting ring 52 in the same order as the rings are to be mounted about the flange body 26. The nested ring assembly is then positioned on the platform 62 by engaging the mounting screws 56 within the cups 94. The engagement of the screws 56 in the cups 94 provides a stable mount for the nested rings since the platform 62 may be tilted and jarred as it is positioned adjacent the end of the flange body 26. In this manner, the platform is used to manipulate and properly position the ring assembly during its installation about the flange body 26. The cam handle 130 is in the unlocked position so as to compress the spring 132 and position the pivot bar 122 so that the leg portion 66 freely passes through the slot 123.

Referring to FIG. 5, the keeper 60 is mounted within the sink flange 22. In this arrangement, the lower end of the head portion 64 of the keeper 60 engages the inside surface of the annular groove 30. The leg portion 66 of the keeper extends downwardly through the drain opening and flange body for engagement with a platform 62.

The head portion 64 of the keeper 60 is sized to engage the inside surface on the flange body 26 and thereby center the leg portion 66 along the axis A. Accordingly, proper alignment of the platform 62, rings 50, 52 and snap ring 54 with the end of the sink flange body 26 is assured by receipt of the leg portion 26 in the central opening 72 in the base 70, the bore 112 in the slide bar 102 and the slot 123 in the pivot bar 122.

Following engagement of the platform 62 with the leg portion 66, that cam handle 130 is operated to the locked position as shown in FIG. 6. In the locked position, the keeper 20 operates against the upper surface 14 of the sink 12 to secure the platform and mounted components in their proper position. The installer may then grasp the lower end of the leg portion 66 with one hand and axially move the slide bar 102 with his other hand to cause the pins 110 to advance the snap ring 54 from the loading shoulder 74 onto the outer surface of the flange body 26 and into the annular groove 30 as shown in dotted outline. Thereafter, the cam handle 130 may be operated back to the unlocked position and/or the distal end 122*b* of the bar 122 may be pressed toward the base 70 to release the leg portion 66 from its frictional engagement within the slot 123. The platform 62 may then be lowered and disengaged from the leg portion 66.

In accordance with the invention, the tool 20 enables the platform 62, together with its mounted components, to be easily installed by one person working below the sink. It should be appreciated that the tool 20 operates to secure the sink flange in position, mount the ring components onto the flange body and dispose the snap ring into the annular groove.

Following the above operation, the back-up ring 50 and the mounting ring 52 are secured to the sink flange 22 by the snap ring 54. Accordingly, the disposal 10 may then be secured to the mounting ring 52 by engaging the body ring hooks 48 with the mounting ledges 58.

Figure 7:
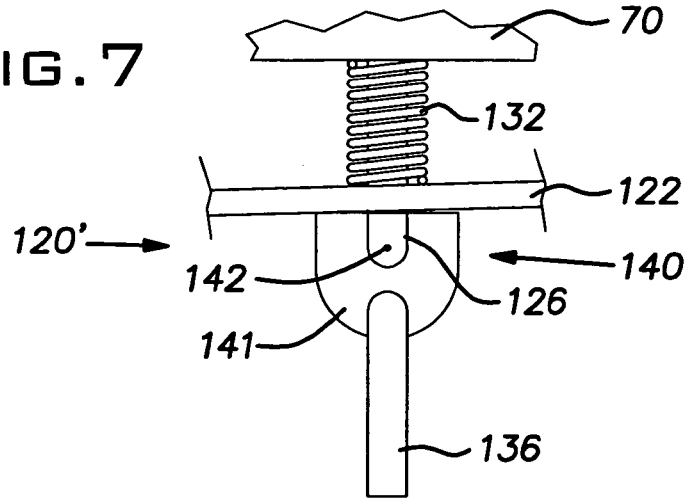
FIG. 7 is a fragmentary side view of a connector in the locked position in accordance with a second embodiment of the invention.

Referring to FIG. 7, a modified locking connector 120' includes a cam handle 140 having a single flat cam 141 pivotally mounted at a rotating joint 142 to the end the mounting pin 126. The lever 136 is rigidly mounted to the cam 141. The connector 120 is shown in the locked position with the spring 132 biasing the pivot bar 122 away from the base 70. The lever 136 is operable to rotate the cam 140 about the joint 142 to displace the pivot bar 122 toward the base 70 in order to release the leg portion 66 from frictional engagement within the slot 123.

Figure 8:
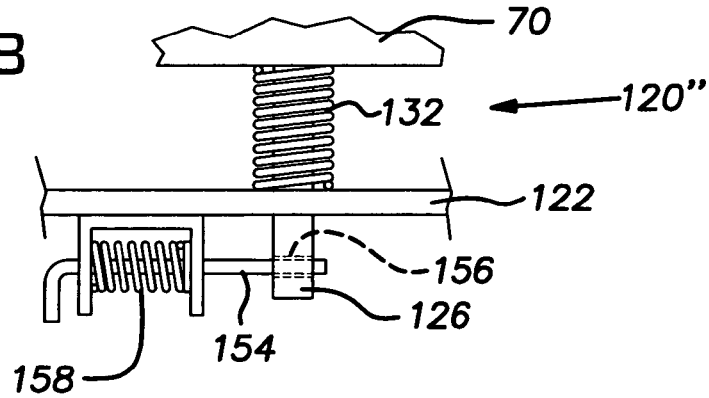
FIG. 8 is a fragmentary side view of a connector in an unlocked position in accordance with a third embodiment of the invention.
Figure 9:
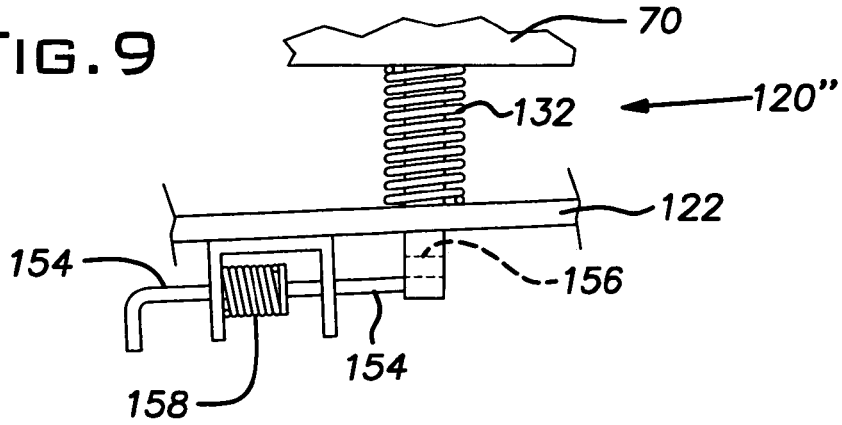
FIG. 9 is a fragmentary side view of the connector of FIG. 8 in the unlocked position.

Referring to FIG. 8, a modified locking connector 120" includes a retractable key latch 150 mounted to the pivot bar 122. The latch 150 includes a holder 152 having a U-shaped configuration with the bite portion thereof fixed to the pivot bar 122. A key 154 extends through bores provided in the opposed legs of the holder 152 and into a bore 156 in the mounting pin 126. The key 154 extends through a spring 158 arranged to resiliently bias the key toward the mounting pin 126. As shown in FIG. 8, the right end of the spring 158 is connected to the key 154 and the spring works against the left leg of the holder 152 to urge the key toward the mounting pin 126.

The connector 120" is shown in a locked position in FIG. 8. In order to unlock the connector 1201", the key 154 is moved to the right in order to disengage the end of the key from the bore 156. Upon disengagement of the key 154 from the bore 156, the spring 132 biases the pivot bar 122 away from the base 70, the pivot bar 122 is disposed at an angle relative to the base 70 and the leg portion 66 is frictionally engaged within the slot 123 as described above.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. A tool for mounting a snap ring to a sink flange for supporting a garbage disposal below a sink, said sink having a top surface, a bottom surface and a sink drain opening having a central axis and extending between said surfaces, said sink flange having a flange lip supported by said top surface about said sink drain opening and a flange body having a cylindrical shape for extending coaxially through the drain opening to a lower end having an annular groove for receiving said snap ring, said tool comprising:

a) a keeper for temporarily securing a platform adjacent said flange body lower end below said sink bottom surface, b) said keeper including a head portion for engaging said sink flange adjacent said top surface of said sink and a leg portion extending from said head portion through said flange body for engagement with said platform, c) said platform including loading means, biasing means and a connector, d) said loading means being arranged to hold said snap ring in an expanded condition for insertion in said annular groove, e) said biasing means being operable to displace said snap ring from said loading means into said annular groove, f) said connector being operable to releasably connect said platform to said leg portion whereby said head portion temporarily secures said platform adjacent to and axially aligned with said lower end of said flange body for axial movement of said snap ring into said annular groove upon operation of said biasing means.

2. A tool as in claim 1, wherein said garbage disposal is supported by a ring assembly adapted to receive and surround said flange body and to be retained on said flange body by insertion of said snap ring in said annular groove, said platform also including ring assembly mounting means for supporting said ring assembly on said platform and surrounding said flange body until said snap ring is inserted in said annular groove.

3. A tool as in claim 2, wherein said mounting ring assembly includes a back-up ring and a support mounting ring that fit about said flange body.

4. A tool as in claim 3, wherein said back-up ring and mounting ring are separate components nested together and supported on said ring assembly mounting means radially outward of said snap ring.

5. A tool as in claim 2, wherein said biasing means includes a slide member for axially pushing said snap ring from said loading means into said annular groove.

6. A tool as in claim 5, wherein said slide member includes a plurality of pins for axially pushing said snap ring into said annular groove.

7. A tool as in claim 6, wherein said slide member is mounted to said platform and resiliently retained in a normal position with said pins in a retracted position.

8. A tool as in claim 7, wherein said loading means comprises an annular shoulder provided by said platform, said shoulder having an axially extending wall connected to a radially extending wall, said snap ring being mounted on said shoulder in said expanded condition and said pins passing through said radially extending wall to bias said snap ring axially off said shoulder and into said annular groove.

9. A tool as in claim 8, wherein said flange body has an outside body diameter, and said axially extending wall of said shoulder has a diameter greater than the outside body diameter of said flange body to facilitate movement of said snap ring from said shoulder onto said flange body and into said annular groove.

10. A tool as in claim 8, wherein said platform also includes a latch movable to an extended snap ring mounting position to trap an annular portion of said snap ring against said annular shoulder as the remaining portion of said snap ring is expanded and positioned around said annular shoulder, and, after positioning said snap ring on said annular shoulder, said latch is movable to a retracted position clear of said snap ring and annular shoulder.

11. A tool as in claim 5, wherein said platform has a opening for receiving said leg portion of said keeper and said connector comprises a locking bar having a bar opening through which said leg portion extends, said locking bar being movable between an unlocked position in which said leg portion moves freely through said bar opening and a locked position angularly intersecting said leg portion to frictionally secure the leg portion within said bar opening.

12. A tool has in claim 11, wherein said locking bar is mounted to said platform for pivotal movement and resiliently biased to said locked position.

13. A tool as in claim 11, wherein said locking bar has a proximal end secured to said platform and a distal end pivotably movable between said locked and unlocked positions, said distal end extending to the lateral extent of the platform to facilitate manual pivotal movement of the bar.

14. A tool for mounting a support ring assembly with a snap ring to a sink flange for supporting a garbage disposal below a sink, said sink having a top surface, a bottom surface and a sink drain opening having a central axis and extending between said surfaces, said sink flange having a flange lip supported by said top surface about said sink drain opening and a flange body having a cylindrical shape for extending coaxially through the drain opening to a lower end having an annular groove for receiving said snap ring, said tool comprising:

a) a keeper for temporarily securing a platform adjacent said flange body lower end below said sink bottom surface, b) said keeper including a head portion for engaging said sink flange adjacent said top surface of said sink and a leg portion extending from said head portion through said flange body for engagement with said platform, c) said platform including a central platform opening for receiving said leg portion, an annular loading shoulder, a snap ring biasing member, a ring assembly mount and a connector for engaging said leg portion, d) said annular loading shoulder having an axially extending wall connected to a radially extending wall, said snap ring being mounted on said shoulder in an expanded condition for insertion in said annular groove, e) said snap ring biasing member being operable from a normally retracted position to an extended position to displace said snap ring from said shoulder into said annular groove, f) said support ring assembly mount comprising angularly spaced members for engaging and supporting said ring assembly on said platform as the ring assembly is positioned about said flange body and secured in position by inserting said snap ring in said annular groove, and g) said connector including a connector opening for receiving and releasably engaging said leg portion whereby said keeper temporarily secures said platform adjacent to and axially aligned with said lower end of said flange body for axial movement of said snap ring into said annular groove upon operation of said biasing member.

15. A tool as in claim 14, wherein said snap ring biasing member comprises a slide bar having a slide bar opening through which said leg portion passes during sliding movement of said slide bar, a plurality of pins extending from said slide bar through said platform to push said snap ring from said loading shoulder and into said annular groove.

16. A tool as in claim 15, wherein said connector comprises a locking bar including said connector opening through which said leg portion extends, said locking bar being movable between an unlocked position in which said leg portion moves freely through said connector opening and a locked position angularly intersecting said leg portion to frictionally secure the leg portion within said connector opening.

17. A tool as in claim 16, wherein said leg portion extends through said central platform opening, said slide bar opening and said connector opening to a free end that may be manually grasped to fix the position of said keeper and sink flange as said slide bar is moved to push said snap ring from said loading shoulder and into said annular groove.

18. A tool as in claim 17, wherein said slide bar and said locking bar are mounted on a said platform of said platform remote of said annular loading shoulder.

* * * * *